US005927178A

United States Patent [19]

Stenquist

[11] Patent Number: 5,927,178

[45] Date of Patent: Jul. 27, 1999

[54] PRESS DRIVEN TOOL ACTUATOR MODULE

[75] Inventor: Sven Stenquist, Bodafors, Sweden

[73] Assignee: Diebolt International, Inc., Plymouth, Mich.

[21] Appl. No.: 08/976,775

[22] Filed: Nov. 24, 1997

[51] Int. Cl.[6] ..... F01B 7/20; F15B 21/04

[52] U.S. Cl. ..... 92/52; 92/165 R; 91/4 R; 91/167 R

[58] Field of Search ..... 92/165 R, 51, 92/52, 53; 51/4 R, 167 R

[56] References Cited

U.S. PATENT DOCUMENTS

| | | | |
|---|---|---|---|
| 3,188,917 | 6/1965 | Quayle | 92/52 X |
| 3,426,651 | 2/1969 | Arendarski | 92/52 X |
| 3,656,411 | 4/1972 | Plester et al. | 92/51 |
| 4,006,669 | 2/1977 | Price | 92/51 X |
| 4,884,493 | 12/1989 | Tootle | 92/165 R X |
| 5,042,253 | 8/1991 | Kataoka | 91/4 R X |
| 5,406,880 | 4/1995 | Haller | 92/52 |
| 5,606,910 | 3/1997 | Katz | 100/208 |

*Primary Examiner*—Hoang Nguyen
*Attorney, Agent, or Firm*—Reising, Ethington, Barnes, Kisselle, Learman & McCulloch, P.C.

[57] ABSTRACT

A hydraulic actuator for a hydraulically driven device has a hydraulic cylinder, a first piston slidably received for reciprocation within the cylinder and defining a hydraulic fluid chamber with the cylinder, a second piston slidably received for reciprocation within a cavity in an actuator rod connected to the first piston and defining a gas chamber on one side of the second piston and an accumulator chamber on the other side of the second piston. A passage formed in the first piston communicates the hydraulic chamber with the accumulator chamber and a pressure relief valve selectively permits hydraulic fluid flow through the passage from the hydraulic chamber to the accumulator chamber to limit the maximum pressure of the hydraulic fluid within the hydraulic chamber and the hydraulically driven device. Preferably, during normal operation of the actuator and the hydraulically driven device the pressure of the hydraulic fluid is less than that required to open the pressure relief valve. The pressure of the gas in the gas chamber and acting on the second piston forces hydraulic fluid in the accumulator chamber into the hydraulic fluid chamber through a check valve when the pressure in the accumulator chamber is greater than the pressure in the hydraulic fluid chamber to reset the accumulator.

18 Claims, 2 Drawing Sheets

PRESS DRIVEN TOOL ACTUATOR MODULE

FIELD OF THE INVENTION

This invention relates generally to fluid actuated cylinders and more particularly to an actuator for fluid actuated cylinders.

BACKGROUND OF THE INVENTION

Press driven tool modules utilizing fluid actuated cylinders have found acceptance due to their adaptability to conventional presses wherein a vertical force input by a press ram to one fluid power cylinder actuates a second fluid work cylinder to provide a horizontal or otherwise directed force output to actuate a tool to form a workpiece spaced from the press ram. This design is flexible in that various tool modules can be used with the same press to provided a number of forming operations actuated by a single press. One such press driven fluid actuated tool module is disclosed in U.S. Pat. No. 5,606,910. In this system a press ram displaces a piston of a hydraulic power cylinder to pressurize the hydraulic fluid and thereby displace a piston of a work cylinder which has a tool mounted thereon to engage the tool with the workpiece. The power cylinder has an upper reservoir containing a reserve supply of hydraulic fluid which when the piston is retracted communicates with a lower portion of the cylinder, which contains the hydraulic fluid to be pressurized by displacement of the piston, after it engages with a high pressure seal to prohibit pressurized fluid from flowing into the upper reservoir. The power cylinder must be disposed in substantially vertically upright position to function properly. When the high pressure seal wears, there is, at the very least, a loss in pressure of the hydraulic fluid when the work cylinder piston is displaced which reduces the efficiency of the system and effects the performance of the work tool in use. Further, wear on the seal can lead to failure of the power cylinder requiring replacement of the entire power cylinder or at least the high pressure seal resulting in increased down time for the system.

SUMMARY OF THE INVENTION

For a hydraulically actuated device a hydraulic power cylinder with, a first piston slidably received for reciprocation within the cylinder and defining a hydraulic fluid chamber with the cylinder, a second piston slidably received for reciprocation within a recess of the first piston and defining a gas chamber on one side of the second piston and an accumulator chamber between the other side of the second piston and the first piston, a passage in the first piston communicating the hydraulic fluid chamber with the accumulator chamber and a pressure relief valve selectively permitting hydraulic fluid flow through the passage from the hydraulic fluid chamber to the accumulator chamber to limit the maximum pressure of the hydraulic fluid within the hydraulic fluid chamber and hence the hydraulically driven device. The pressure relief valve may also permit hydraulic fluid within the accumulator chamber to reverse flow through the passage to the hydraulic fluid chamber when the pressure of gas within the gas chamber, which acts on the fluid in the accumulator chamber through the second piston, is greater than the pressure within the hydraulic fluid chamber to maintain a sufficient volume of hydraulic fluid within the hydraulic fluid chamber for the next cycle of the hydraulic power cylinder. Otherwise, a check valve may be provided to permit fluid flow out of the accumulator chamber to the hydraulic fluid chamber while preventing reverse fluid flow into the accumulator chamber.

In one form, the hydraulic actuator is used to drive a work cylinder having a work tool to form a workpiece adjacent the work cylinder. Preferably, a press displaces the first piston to decrease the volume of the hydraulic chamber and force hydraulic fluid under pressure from the hydraulic actuator to the work cylinder to drive a piston of the work cylinder and displace the associated work tool to form the workpiece. A biasing member in the work cylinder and acting on its piston returns the hydraulic actuator to its unloaded position when the press ram is retracted from the first piston. During a normal cycle, the pressure of the hydraulic fluid does not reach a pressure sufficient to open the pressure relief valve and cause hydraulic fluid to enter the accumulator chamber. Therefore, the second piston is displaced adjacent to and preferably into contact with the first piston by the pressure of the gas in the gas chamber and remains in this position until the work cylinder becomes jammed, such as may happen when the work tool becomes jammed with the workpiece or associated die, causing the pressure of the hydraulic fluid to rise to the pressure at which the pressure relief valve opens. When the pressure relief valve is open, the hydraulic fluid flows from the hydraulic fluid chamber into the accumulator chamber and thereby displaces the second piston to increase the volume of the accumulator chamber and limit the maximum pressure of the hydraulic fluid in the system. The pressure relief valve, or preferably a check valve, permits the free flow of fluid from the accumulator chamber to the hydraulic fluid chamber and thus, when the pressure within the accumulator chamber is greater than that within the hydraulic fluid chamber, fluid will flow out of the accumulator chamber and into the hydraulic fluid chamber.

Objects, features and advantages of this invention include providing a hydraulic actuator with an internal accumulator which limits the maximum pressure within the hydraulic actuator and within a device driven by the hydraulic actuator, does not require a separate accumulator for overpressure relief, is readily adaptable to many hydraulic cylinder applications, can automatically drain the accumulator when the pressure within the system is relieved to reset the actuator, improves the in-service useful life of the high pressure seals, maintains a continuous seal between the cylinder and the actuator piston, provides a pressurized return of hydraulic fluid from the accumulator to the hydraulic cylinder, returns hydraulic fluid from the accumulator regardless of the orientation of the hydraulic actuator, may maintain a reserve supply of hydraulic fluid in the accumulator, is reliable and durable and of relatively simple design and economical manufacture, and has a long and useful life in service.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENTS

Figure 1:
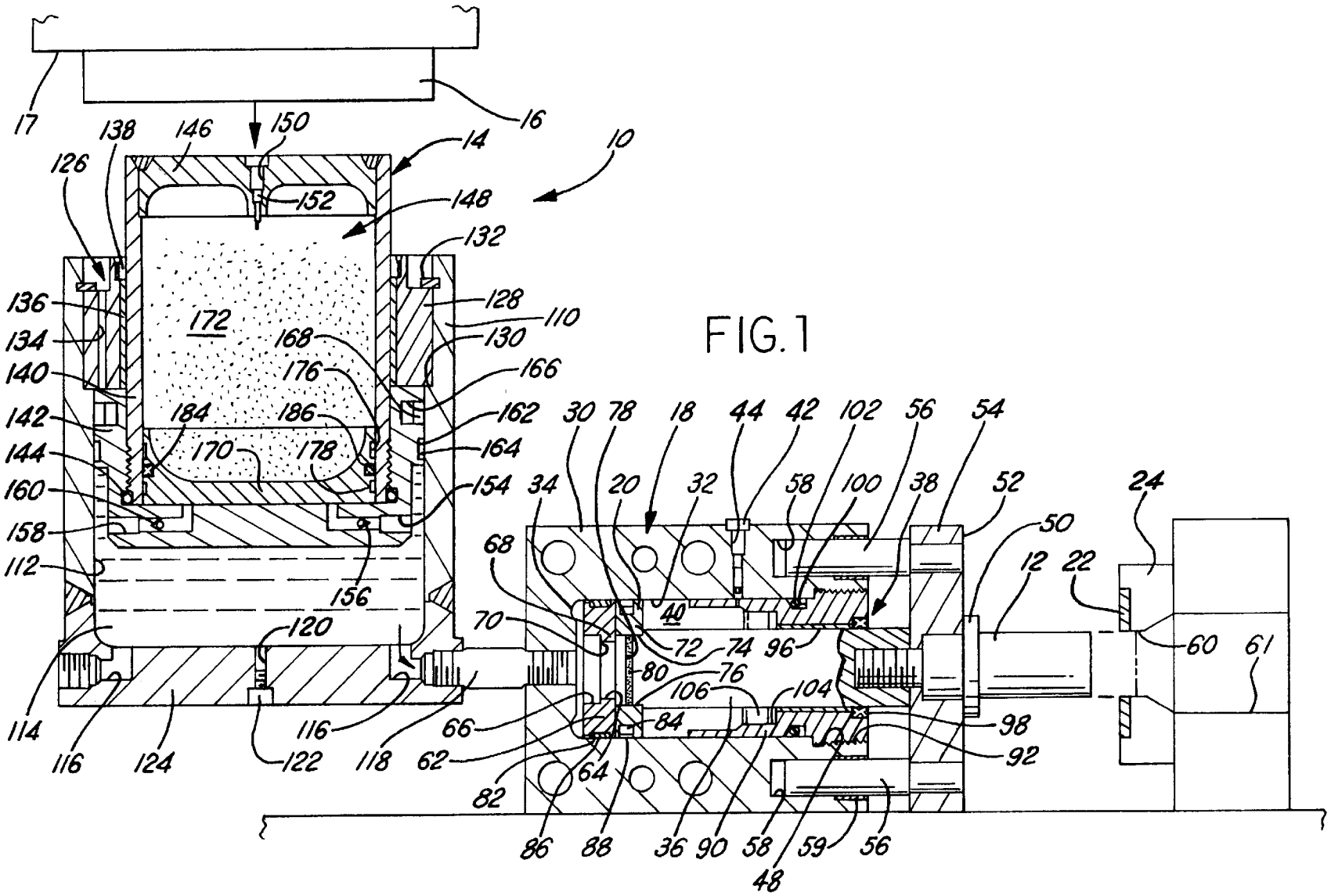
FIG. 1 is a sectional view of a press driven tool module having a hydraulic actuator embodying this invention.

Referring in more detail to the drawings, FIG. 1 illustrates a hydraulic actuator 10 for a hydraulically driven work tool 12 and having a first piston 14 displaceable by a ram 16 of a press 17 to pressurize hydraulic fluid in the actuator 10 and deliver it to a work cylinder 18 to drive a work cylinder piston 20 and thereby advance the work tool 12 along its axis to punch a hole or form a workpiece 22 received on a carrier 24. After the forming operation is complete, the press ram 16 is retracted or withdrawn and the first piston 14 is returned to its retracted position by a biasing means, such as a spring or gas under pressure within a gas chamber 40 which acts on the work cylinder piston 20 to return it to its retracted position and displace the hydraulic fluid back into the actuator 10 thereby displacing the first piston 14 to its retracted position. With the system reset in its starting position, a subsequent cycle of the hydraulic actuator 10 and the work tool 12 can be performed to form another workpiece 22.

The work cylinder 18 has a cylinder body 30 with the piston 20 slidably received for reciprocation within a bore 32 of the cylinder body 30 and defining a hydraulic fluid pressure chamber 34. A piston rod 36 operably connects the piston 20 with the work tool 12 and is slidably received in a bearing and seal assembly 38 disposed in the bore 32 and defining a gas chamber 40 in conjunction with the bore 32 and the piston 20. A filler valve 42 is received in a passage 44 through the sidewall of the cylinder body 30 through which gas under pressure is admitted to the gas chamber 40. The work tool 12 is preferably threadably received in a threaded blind bore 48 in the free end of the piston rod 36 and has an enlarged flange 50 bearing on a flat face 52 of a guide plate 54 fixed to two or more legs 56 slidably received in blind bores 58 and bushings 59 in the cylinder body 30 to guide the work tool 12 for linear reciprocation. This reduces the side loads on the piston rod 36 and bearing assembly 38. The workpiece 22 is held by the carrier 24 which, as shown in FIG. 1, has a through bore 60 and a counterbore 61 constructed to receive the work tool 12 therein to punch a hole in the workpiece 22 and provide an exit passage for the slug punched from the workpiece.

An annular, diametrically split retainer ring 62 has a through bore 64 and a counterbore 66 providing a rib 68 received in an annular groove 70 in the end of the piston rod 36. The piston 20 is received on a reduced diameter end portion of the piston rod 36 and is held between an annular shoulder 76 of the piston rod 36 and the retainer ring 62. The piston rod 36 has a circumferential groove 78 formed therein adjacent the piston 20 and constructed to receive a sealing member 80 to provide a fluid tight seal between the piston 20 and the piston rod 36. The retainer ring 62 has a circumferential groove 82 to carry an annular bearing 86 which guides the piston 20 for linear reciprocation. The piston also has a circumferential groove 84 which carries a sealing member, such as an O-ring 88, to provide a fluid-tight seal between the gas chamber 40 and the pressure chamber 34.

The bearing and sealing assembly 38 has an annular body 90 with a threaded portion 92 received in the threaded bore 48 of the cylinder body 30, an annular bearing 96 carried by the body 90 and received closely adjacent the piston rod 36 to guide the piston rod 36 as it reciprocates and an annular wiper 98 carried by the body 90 and constructed to circumferentially engage the piston rod 36 to prevent contaminants from entering the bearing and sealing assembly 38. To provide a fluid tight seal between the cylinder body 30 and the body 90 a sealing member such as an O-ring 102 is received in a groove 100 in the body 90 to prevent leakage of the gas from the chamber 40. To provide a fluid tight seal preventing leakage of gas from the chamber 40 between the piston rod 36 and the body 90 an annular sealing member such as an O-ring 106 is received in a groove 104 in the body.

Figure 2:
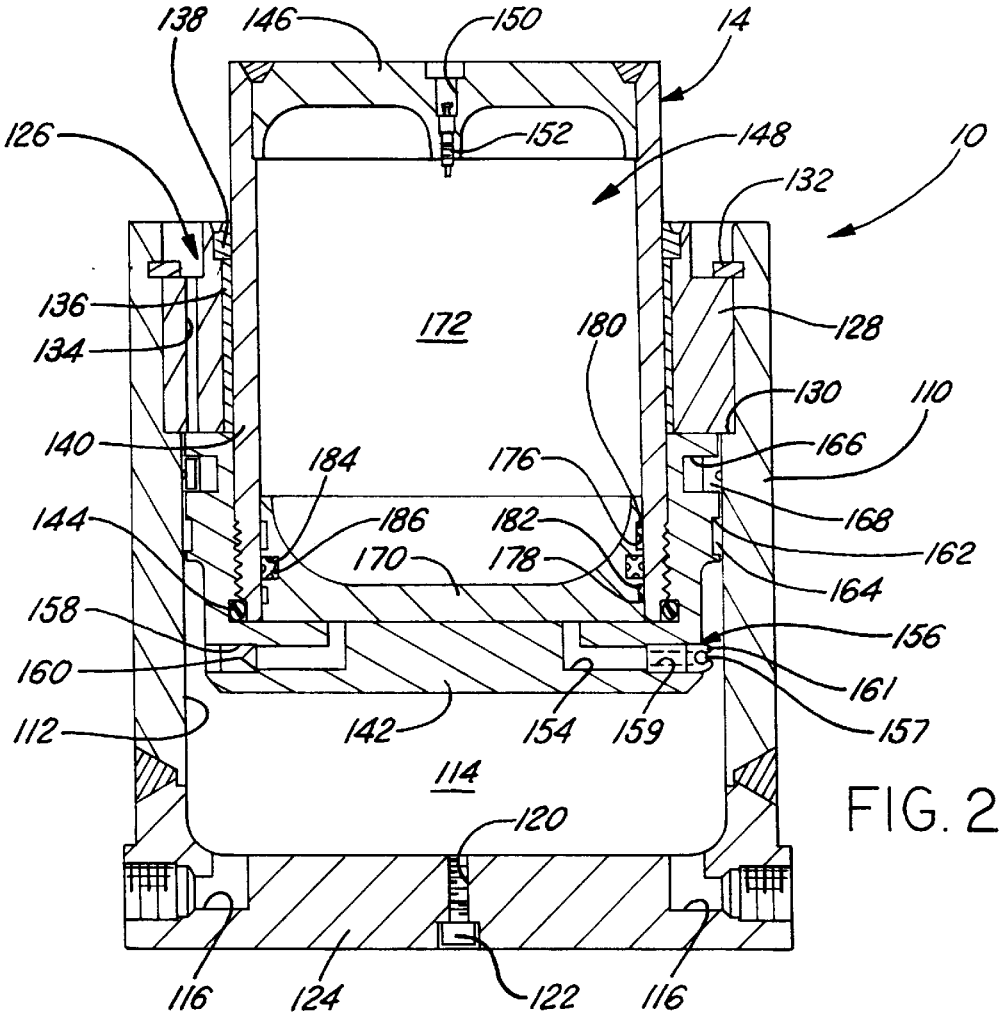
FIG. 2 is a cross-sectional view of the hydraulic actuator of FIG. 1 shown in its retracted position.
Figure 3:
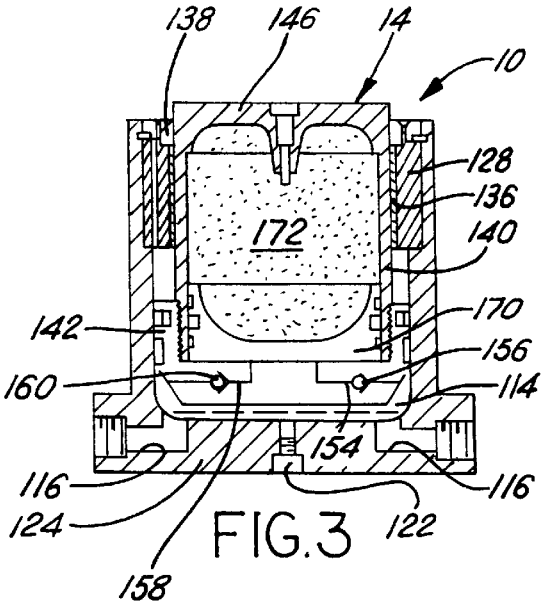
FIG. 3 is a cross sectional view of the hydraulic actuator of FIG. 1 shown in its advanced position.

The hydraulic actuator 10 has a cylinder body 110 with a cylindrical bore 112 constructed to slidably receive the first piston 14 for linear reciprocation between a retracted position, as shown in FIG. 2 and an advanced position, as shown in FIG. 3. Movement of the first piston 14 towards its advanced position reduces the volume of a hydraulic fluid chamber 114 defined between the first piston 14 and the cylinder body 110 to pressurize the hydraulic fluid in the chamber 114 and displace it through an outlet passage 116 and a conduit such as a flexible hose 118 which communicates with the pressure chamber 34 of the work cylinder 18. If desired, more than one outlet 116 may be provided so the actuator 10 can simultaneously drive more than one work cylinder 18. The chamber 14 is filled with hydraulic fluid through a passage 120 in the bottom wall 124 of the cylinder body 110 in which a threaded plug such as a screw 122 is removably received.

The first piston 14 has a cylindrical sleeve 140 threadably attached to a cup-shaped base 142 to close the bottom of the sleeve 140 with a sealing member such as O-ring 144 received between them. A cap 146 closes the upper end of the sleeve 140 and is preferably welded or otherwise attached and sealed to the sleeve 140 to define an enclosure 148 in cooperation with the sleeve 140 and base 142. To admit gas under pressure into the enclosure 148 of the first piston 14 the cap 146 has a through passage 150 with a gas filler valve 152 received therein.

A second piston 170 is slidably received for reciprocation in the enclosure 148 of the first piston 14 and defines in part a gas chamber 172 on one side of the second piston 170 and an accumulator chamber 174 (FIG. 4) on its other side. A pair of spaced apart circumferential grooves 176, 178 are formed about the periphery of the second piston 170 and are each constructed to receive an expandable split piston ring providing a sealing and wiper member 180, 182 therein. A third annular groove 184 formed in the piston, preferably between the grooves 176, 178, is constructed to receive a circumferentially continuous elastomeric seal 186 providing a fluid tight seal to prevent leakage between the gas chamber 172 and accumulator chamber 174. This prevents cross contamination of the gas chamber 172 and accumulator chamber 174 as the second piston 170 is displaced.

The piston base 142 has a first passage 154 communicating the hydraulic fluid chamber 114 with the accumulator chamber 174 and a pressure relief valve 156 disposed in the first passage 154 prevents the flow of hydraulic fluid through the passage 154 until a predetermined maximum pressure is reached in the hydraulic fluid chamber 114. The pressure relief valve has a ball 157 yieldably biased by a spring 159 onto an annular seat 161 of a ring threaded into the passage 154. A second passage 158 formed through the base 142 of the first piston 14 has a check valve 160 disposed therein which may be of substantially any construction suitable to permit hydraulic fluid flow from the accumulator chamber 174 into the hydraulic fluid chamber 114 but prevent reverse flow from the hydraulic fluid chamber 114 into the accumulator chamber 174. An annular groove 162 about the periphery of the base 142 receives a bearing 164 therein and another annular groove 166 receives a seal 168 providing a fluid tight seal between the first piston 14 and the cylinder body 110 to prevent the hydraulic fluid from leaking between them.

A bearing and retainer assembly 126 is received within the cylinder body 110 around the sleeve 140 of the first piston 14 and has an annular body 128 received in a counterbore 130 in the cylinder body 110 and retained therein by an annular retainer ring 132 received in a groove in the interior of the sidewall of the cylinder body 110. A vent passage 134 through the body 110 eliminates any differential pressure across the bearing and retainer assembly 126 as the first piston reciprocates in use. An annular bearing 136 is carried by the body 128 and slidably receives the sleeve 140 to guide the first piston 14 for reciprocation. An annular wiper 138 is also carried by the body 128 and circumferentially engages the sleeve 140 of the first piston 14 as it reciprocates to prevent contaminants from entering the actuator 10.

Operation

In use, as the press ram 16 is advanced it moves the first piston 14 from its retracted position (FIG. 2) to its advanced position (FIG. 3) to displace the hydraulic fluid from the chamber 114 to the work cylinder 18 pressure chamber 34. The hydraulic fluid displaces the work cylinder piston 20 to advance the work tool 12 axially and punch a hole in the workpiece 22 on the carrier 24. As the work cylinder piston 20 is advanced, the volume of the work cylinder gas chamber 40 is reduced thereby increasing the pressure of the gas therein. As the press ram 16 is retracted, the pressurized gas in the work cylinder gas chamber 40 displaces the work cylinder piston 20 to return the hydraulic fluid from the pressure chamber 34 to the hydraulic fluid chamber 114 of the actuator 10 to thereby displace and retract the first piston 14 and reset the work cylinder piston 20 and first piston 14 to their initial or fully retracted positions.

Figure 4:
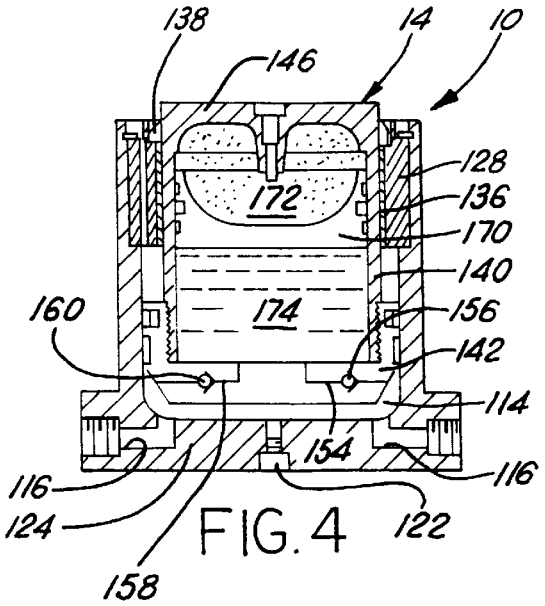
FIG. 4 is a cross sectional view of the hydraulic actuator illustrating the internal accumulator of the actuator.

As shown in FIG. 4, the second piston 170 is displaced by hydraulic fluid which enters the accumulator chamber 174 through the first passage 154 when the pressure in the hydraulic fluid chamber 114 reaches the predetermined maximum pressure at which the relief valve 156 opens and hydraulic fluid flows through the pressure relief valve 156 and into the accumulator chamber 174. Typically, the normal operating pressure of the hydraulic actuator 10 is below the pressure required to open the pressure relief valve 156 and the pressure within the system only exceeds the pressure required to open the pressure relief valve 156 when the hydraulic actuator 10 or the hydraulically driven device 18 powered by the actuator 10 becomes jammed or otherwise malfunctions causing an increase in the operating pressure of the system. Thus, the volume of the accumulator chamber 174 increases when such a malfunction occurs and the hydraulic fluid is forced through the valve 156 to prevent the pressure within the system from exceeding a predetermined maximum pressure to prevent damage to the hydraulic actuator 10, the work cylinder 18, work tool 12 and workpiece 22. In some applications, the pressure relief valve 156 is constructed to open under a pressure of 250 bars although the maximum pressure can be readily changed as desired for a given application.

As the accumulator chamber 174 volume increases, the gas chamber 172 volume decreases and the gas therein becomes increasingly pressurized. Typically, the gas (such as nitrogen) in the first piston gas chamber 172 is at an initial pressure of 150 psi, about 10 bars, when the volume of the accumulator chamber 174 is at or near zero as shown in FIGS. 2 and 3. The check valve 160 permits the hydraulic fluid in the accumulator chamber 174 to flow back into the hydraulic fluid chamber 114 through the second passage 158 when the pressure within the accumulator chamber 174 is greater than the pressure in the hydraulic chamber 114. When the pressure in the hydraulic fluid chamber 114 is less than the pressure within the gas chamber 172 acting on the fluid in the accumulator chamber 174, the gas will displace the second piston 170 to force some of the hydraulic fluid therein through the second passage 158 and back into the hydraulic fluid chamber 114. As the pressure in the system is reduced, the jammed portion of the system can be released to further reduce the pressure and as the first piston 14 reaches its fully retracted position, the gas in the gas chamber 172 will force the hydraulic fluid in the accumulator chamber 174 back into the hydraulic fluid chamber 114 to reset the hydraulic actuator 10 to its fully retracted position as shown in FIGS. 1 and 2.

If desired, the accumulator chamber 174 may contain a small reserve supply of hydraulic fluid under the pressure of the gas in the gas chamber 172 acting on the second piston 170. To maintain this reserve hydraulic fluid supply, the pressure in the hydraulic fluid chamber 114 must be maintained above the pressure in the accumulator chamber 174 even when the first piston 14 is in its fully retracted position.

The hydraulic actuator 10 can be driven by a press ram 16 to drive one or more hydraulically driven devices and has an internal accumulator chamber 174 to limit the maximum pressure in the actuator 10 and the hydraulically driven device and thereby prevent damage to them. The accumulator chamber 174 is acted on by gas under pressure within a gas chamber 172 to automatically reset the actuator 10 when the pressure of the hydraulic fluid is reduced so that the actuator 10 is ready for subsequent cycles. If desired, a reserve supply of hydraulic fluid may be maintained in the accumulator chamber 174 under the pressure of the gas in the gas chamber 172 to insure that a sufficient volume of hydraulic fluid is maintained within the actuator 10. This reserve supply of hydraulic fluid is maintained without the need for defining a separate reservoir dependent on a high pressure seal between the reservoir and hydraulic fluid chamber. Thus, the actuator 10 limits the maximum pressure within the system without the need for a separate accumulator and is not dependent on high pressure seals and is thereby durable, reliable and has a long and useful life in service.

I claim:

1. A hydraulic actuator for at least one hydraulically powered device comprising:

a hydraulic cylinder having a body with a cylindrical bore formed in the body and at least one outlet passage constructed to communicate with a hydraulically powered device;

a first piston slidably received for reciprocation within the bore of the body between retracted and advanced positions;

a hydraulic chamber defined between the body and the first piston. constructed to contain a hydraulic fluid therein and communicating with the outlet passage;

an actuator rod connected to the first piston for movement in unison with the first piston and extending externally of the body when the first piston is retracted;

a cylindrical cavity within the actuator rod;

a second piston slidably received within the cylindrical cavity and defining in part a gas chamber on one side of the second piston and an accumulator chamber on the other side of the second piston;

a passage in the first piston communicating the hydraulic chamber with the accumulator chamber; and a pressure relief valve permitting hydraulic fluid flow through the passage from the hydraulic chamber to the accumulator chamber to move the second piston when the hydraulic fluid pressure within the hydraulic chamber reaches a predetermined maximum pressure so that as the first piston is displaced from its retracted position towards its advanced position to pressurize and displace hydraulic fluid from the hydraulic chamber through the outlet passage to actuate the hydraulically powered device, the pressure of such hydraulic fluid is limited to said predetermined maximum pressure by the pressure relief valve and accumulator chamber to limit the maximum pressure of hydraulic fluid within the actuator and the hydraulically powered device.

2. The actuator of claim 1 which also comprises a check valve which permits fluid flow from the accumulator chamber to the hydraulic chamber but prevents fluid flow from the hydraulic chamber to the accumulator chamber.

3. The actuator of claim 2 which also comprises a second passage in the first piston communicating the accumulator chamber with the hydraulic chamber and wherein the check valve is disposed within the second passage in the first piston.

4. The actuator of claim 2 wherein the gas chamber is filled with a gas under sufficient pressure to displace the second piston and thereby force any hydraulic fluid in the accumulator through the check valve and into the hydraulic chamber when the first piston is in its fully retracted position.

5. The actuator of claim 3 wherein the gas chamber is filled with a gas under sufficient pressure to displace the second piston and thereby force at least some of any hydraulic fluid in the accumulator through the check valve and into the hydraulic chamber when the first piston is in its fully retracted position.

6. The actuator of claim 1 wherein the actuator rod has a generally tubular sidewall with a pair of generally opposed open ends, the first piston closes one end and a cap closes the other end with the second piston received within the sidewall between the first piston and cap.

7. The actuator of claim 6 which also comprises a sealing member carried by the first piston to prevent the hydraulic fluid in the hydraulic chamber from leaking out between the first piston and the hydraulic cylinder body.

8. The actuator of claim 6 wherein the tubular sidewall is threadably received by a complementarily threaded portion of the first piston.

9. The actuator of claim 2 which also comprises a second passage in the first piston communicating the hydraulic chamber with the accumulator chamber and the check valve controls the fluid flow through the second passage.

10. The actuator of claim 1 which also comprises a filler valve carried by the actuator rod and through which gas under pressure is admitted into the gas chamber.

11. The actuator of claim 1 wherein the pressure relief valve permits fluid flow from the hydraulic chamber to the accumulator chamber when the pressure in the hydraulic chamber exceeds 250 bars.

12. The actuator of claim 1 wherein the gas in the gas chamber is at a pressure not greater than about 15 bars when the gas chamber is at its maximum volume.

13. The actuator of claim 1 which also comprises a bearing carried by the first piston adjacent the hydraulic cylinder body and constructed to guide the first piston for reciprocation between its retracted and advanced positions.

14. The actuator of claim 1 which also comprises an actuator rod bearing carried by the hydraulic cylinder body and constructed to slidably receive the actuator rod to guide the movement of the actuator rod.

15. The actuator of claim 14 wherein the actuator rod bearing is releasably retained in the hydraulic cylinder body and is engageable by the first piston to retain the first piston in the bore of the hydraulic cylinder body.

16. The accumulator of claim 1 wherein the pressure relief valve permits fluid flow from the hydraulic chamber to the accumulator chamber at the predetermined maximum pressure in the hydraulic chamber of not greater than 240 bars.

17. The actuator of claim 16 which also comprises a check valve which permits fluid flow from the accumulator chamber to the hydraulic chamber but prevents fluid flow from the hydraulic chamber to the accumulator chamber.

18. A hydraulic actuator for at least one hydraulically powered device comprising:

a hydraulic cylinder having a body with a cylindrical bore formed in the body and at least one outlet passage constructed to communicate with a hydraulically powered device;

a first piston slidably received for reciprocation within the bore of the body between retracted and advanced positions;

a hydraulic chamber defined between the body and the first piston, constructed to contain a hydraulic fluid therein and communicating with the outlet passage;

an actuator rod connected to the first piston for movement in unison with the first piston and extending externally of the body when the first piston is retracted;

a cylindrical cavity within the actuator rod;

a second piston slidably received within the cylindrical cavity and defining in part a gas chamber on one side of the second piston and an accumulator chamber on the other side of the second piston;

a gas at a superatmospheric pressure in the gas chamber to yieldably bias the second piston;

a check valve which permits hydraulic fluid to flow from the accumulator chamber to the hydraulic chamber when the first piston is in the fully retracted position and prevents reverse flow through the check valve of hydraulic fluid from the hydraulic chamber to the accumulator chamber as the first piston is advanced from its fully retracted position;

a passage in the first piston communicating the hydraulic chamber with the accumulator chamber; and a pressure relief valve permitting hydraulic fluid flow through the passage from the hydraulic chamber to the accumulator chamber to move the second piston when the hydraulic fluid pressure within the hydraulic chamber reaches a predetermined maximum pressure so that as the first piston is displaced from its retracted position towards its advanced position to pressurize and displace hydraulic fluid from the hydraulic chamber through the outlet passage to actuate the hydraulically powered device, the pressure of such hydraulic fluid is limited to said predetermined maximum pressure by the pressure relief valve and accumulator chamber to limit the maximum pressure of hydraulic fluid within the actuator and the hydraulically powered device.

* * * * *

UNITED STATES PATENT AND TRADEMARK OFFICE

CERTIFICATE OF CORRECTION

PATENT NO. : 5,927,178

DATED : July 27, 1999

INVENTOR(S) : Sven Stenquist

It is certified that error appears in the above-indentified patent and that said Letters Patent is hereby corrected as shown below:

Col 7, Line 46, change "claim 2" to -- claim 4 --.

Signed and Sealed this

Ninth Day of January, 2001

*Attest:*

Q. TODD DICKINSON

*Attesting Officer*

*Commissioner of Patents and Trademarks*